US012593943B2

(12) United States Patent
De Silva et al.

(10) Patent No.: US 12,593,943 B2
(45) Date of Patent: Apr. 7, 2026

(54) WALL MOUNTED DISPENSER

(71) Applicant: Machan Investments LLC, Gardena, CA (US)

(72) Inventors: Anuradha Andy De Silva, Ranchos Palos Verdes, CA (US); Shehan James, Aliso Viejo, CA (US); Dinesh Weerasekera, Fullerton, CA (US)

(73) Assignee: Hotel Emporium Inc, Gardena, CA (US)

( * ) Notice: Subject to any disclaimer, the term of this patent is extended or adjusted under 35 U.S.C. 154(b) by 146 days.

(21) Appl. No.: 18/768,625

(22) Filed: Jul. 10, 2024

(65) Prior Publication Data

US 2026/0013677 A1 Jan. 15, 2026

(51) Int. Cl.
*A47K 5/12* (2006.01)

(52) U.S. Cl.
CPC ..... *A47K 5/1205* (2013.01); *A47K 2201/025* (2013.01)

(58) Field of Classification Search
CPC ..... A47K 5/1205; A47K 5/1207; A47K 5/06–18; A47K 2201/02–025
See application file for complete search history.

(56) References Cited

U.S. PATENT DOCUMENTS

| | | | | |
|---|---|---|---|---|
| 5,613,625 | A * | 3/1997 | Specht | B65D 79/00 222/325 |
| 5,791,525 | A * | 8/1998 | Fan | A47K 5/1204 222/325 |
| 10,321,790 | B2 * | 6/2019 | Schalitz | B05B 11/1014 |
| 10,527,224 | B1 * | 1/2020 | Park | F16M 13/02 |
| D918,017 | S * | 5/2021 | Park | D8/349 |
| 11,332,279 | B2 * | 5/2022 | Lowance | A47K 5/1205 |
| 11,576,534 | B2 * | 2/2023 | Bing | A47K 5/1205 |
| D1,068,491 | S * | 4/2025 | Zhu | D6/545 |

* cited by examiner

*Primary Examiner* — Frederick C Nicolas
*Assistant Examiner* — Randall A Gruby
(74) *Attorney, Agent, or Firm* — Eric Karich; Karich & Associates

(57) ABSTRACT

A dispenser that is adapted for mounting on a wall surface and for dispensing a fluid has an outer container with a base portion and a cap portion. The cap portion is removably mounted on the base portion to together define an interior compartment. A dispensing mechanism extends through an aperture in the cap portion. An inner container is positioned within the interior compartment of the outer container and operably connected with the dispensing mechanism. The inner container is adapted for storing the fluid so that it may be dispensed through the dispensing mechanism. A block extends outwardly from the outer container, the block having a top block portion that extends from the cap portion, and a bottom block portion that extends from the base portion of the outer container. A mounting structure has a front surface and a back surface, wherein the back surface of the mounting structure is adapted for mounting on the wall surface. A female receiver is formed in the mounting structure, the female receiver being sized and shaped to receive the block into the female receiver.

6 Claims, 5 Drawing Sheets

WALL MOUNTED DISPENSER

BACKGROUND OF THE INVENTION

Field of the Invention

This invention relates generally to fluid dispensing containers, and more particularly to a wall-mounted fluid dispensing container.

Description of Related Art

Park, U.S. Pat. No. 10,527,224, teaches a dispenser system that includes an inconspicuous, tamper-resistant bracket used to mount containers, bottles, vessels, dispensers or other articles to a wall surface. A coupling structure engages with and supports the article for use. The coupling structure may comprise a male-female coupling structure including, for example, a vertical rail on one of the bracket or container, and a corresponding vertical slot on the other of the bracket or container. An upper panel, door or lid opens with a tool or key, providing access to the bracket coupling structure. A spring biases the panel, door or lid into an open condition, and a latch mechanism maintains the panel, door or lid in a closed and locked condition until opened. The system may further including a proprietary container with dimensions to visually obscure the bracket. The container may include a dispensing pump, and may be filled or refilled with a personal hygiene product.

Gerenraich, U.S. Pat. No. 7,290,683, teaches a flush mount dispensing bottle and apparatus includes a bracket having a mounting flange and a bottle having a flat back with an embossment for receiving the flange and enabling the flat back to flushly contact a surface supporting the bracket. A button attachable to the surface at a spaced apart distance from the bracket is provided and a second embossment receiving the button enables the flat back to flushly contact the surface and further prevents unauthorized removal of the bottle from the bracket.

Sanguinet et al, U.S. Pat. No. 8,833,596, teaches a mounting bracket for use with a container. The container has a wall extending from a bottom to an upper edge and has a mounting flange extending outwardly from a portion of the wall. The mounting flange includes an outer surface with a terminal edge leading to upper and lower edges and a pair of distal sides. The mounting bracket has a support side positionable towards the wall of the container. The support side includes a notched section with a base extending outwardly from the support side and a pair of lateral faces extending outwardly and away from edges of the base. Each lateral face includes a member positioned along a portion thereof and which extends towards the other member in a tapering edge such that the sides of the mounting flange are captured between the support side and the extending members.

Spector et al., U.S. Pat. No. 10,912,360, teaches a magnetic pouch attachment mechanism includes one or more magnetic pouch mounts having an alignment plate with one or more magnetic areas disposed within the alignment plate. The magnetic pouch mount also includes a pouch removably coupled with the one or more magnetic pouch mounts such that when the pouch is placed in proximity to the one or more magnetic pouch mounts, an attractive magnetic force is exerted between the pouch and the one or more magnetic pouch mounts such that the pouch aligns with and couples to the one or more magnetic pouch mounts. A mounting bracket coupled to the pouch includes one or more bracket magnetic areas disposed within the mounting bracket and configured to induce an attractive magnetic force with the one or more magnetic areas.

Marinelli, U.S. Pat. No. 11,357,362, teaches a dispenser unit having a bottle suitable for containing a liquid product, a dispenser and a fixing system with a first plate suitable for being fixed to a wall, a second plate suitable for being fixed to the bottle in a recessed seat of the bottle and coupled with the first plate, and a key suitable for uncoupling the first plate from the second plate.

SUMMARY OF THE INVENTION

The present invention teaches certain benefits in construction and use which give rise to the objectives described below.

The present invention provides a dispenser that is adapted for mounting on a wall surface and for dispensing a fluid. The dispenser comprises an outer container having a base portion and a cap portion, the cap portion being removably mounted on the base portion to together define an interior compartment. A dispensing mechanism extends through an aperture in the cap portion. An inner container is positioned within the interior compartment of the outer container and operably connected with the dispensing mechanism. The inner container is adapted for storing the fluid so that it may be dispensed through the dispensing mechanism. A block extends outwardly from the outer container, the block having a top block portion that extends from the cap portion, and a bottom block portion that extends from the base portion of the outer container. A mounting structure has a front surface and a back surface, wherein the back surface of the mounting structure is adapted for mounting on the wall surface. A female receiver is formed in the mounting structure, the female receiver being sized and shaped to receive the block into the female receiver.

A primary objective of the present invention is to provide a dispenser having advantages not taught by the prior art.

Another objective is to provide a dispenser that includes a mounting structure that can be securely mounted to a wall surface, and a container that can be removably mounted on the mounting structure.

Another objective is to provide a dispenser that includes a container that cannot be opened when it is mounted on a mounting structure, as the mounting structure itself prevents twisting a lid of the container to open it.

Another objective is to provide a dispenser enables the container to be locked onto the mounting structure, but quickly and easily unlocked using a simple tool so that the container may be removed for refilling.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention.

DETAILED DESCRIPTION OF THE INVENTION

The above-described drawing figures illustrate the invention, a wall mounted dispenser for dispensing liquids such as shampoo, conditioner, soap, oils, lotion, etc., and any other such liquids that a user might want to dispense.

Figure 1:
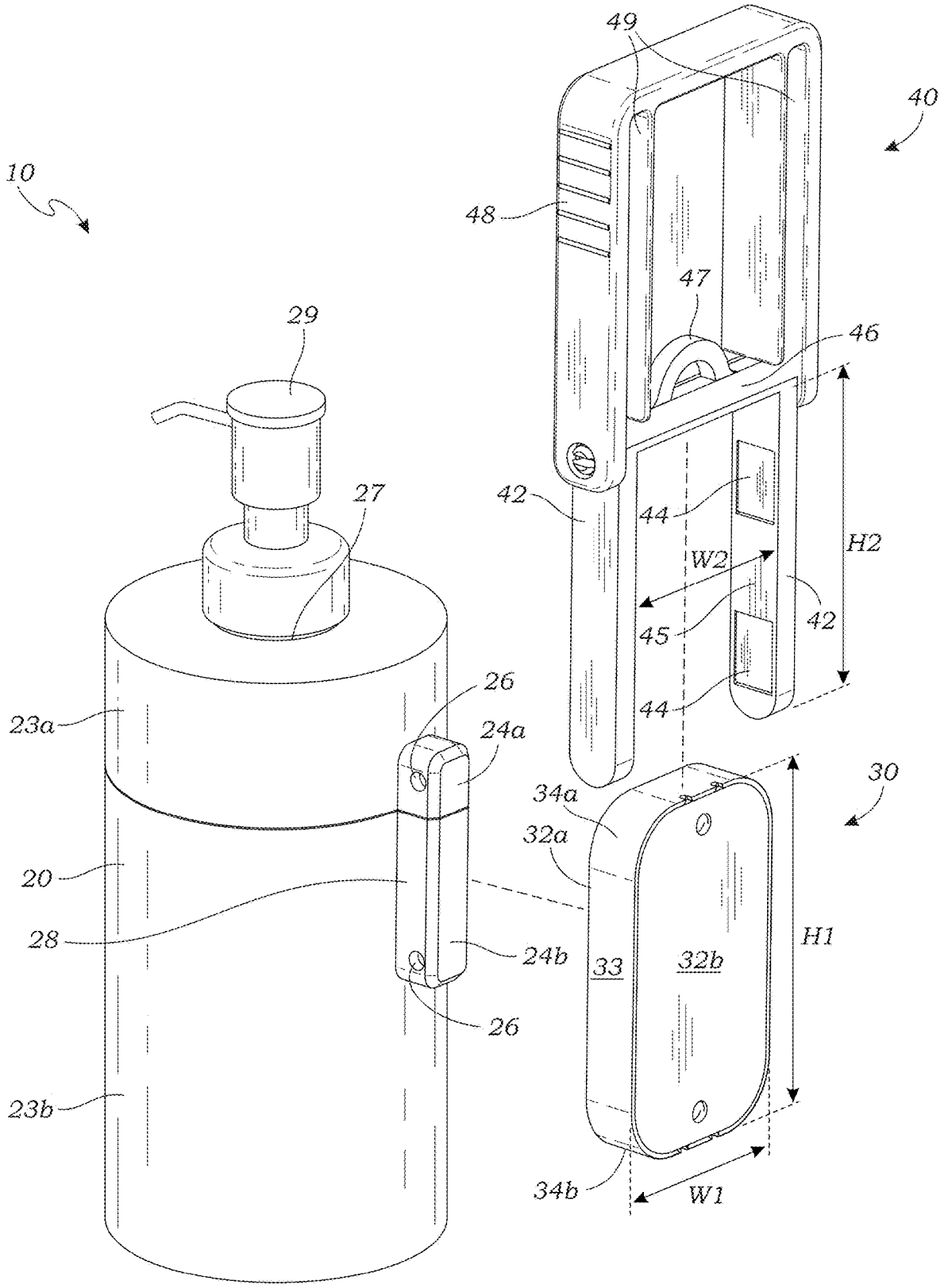
FIG. 1 is a rear perspective view of a dispenser for mounting on a wall surface according to one embodiment of the present invention, illustrating a mounting structure, an outer container, and an unlocking tool.
Figure 2:
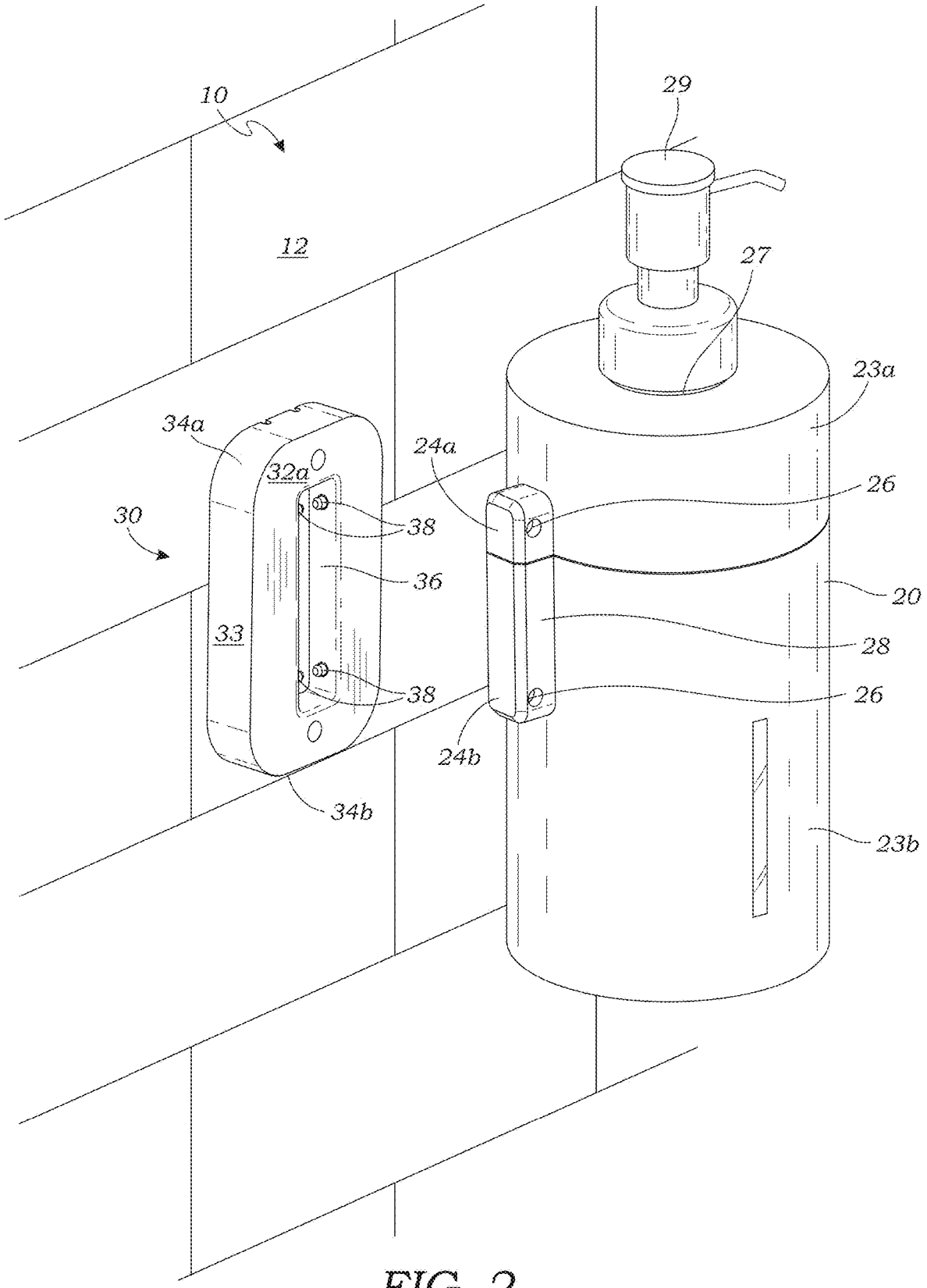
FIG. 2 is a front perspective view of the dispenser, illustrating a mounting structure mounted upon a wall surface, and an outer container that is positioned to be mounted upon the mounting structure.

FIG. 1 is an exploded rear perspective view of a dispenser 10 according to one embodiment of the present invention, and showing an outer container 20, a mounting structure 30, and an unlocking tool 40, each component being discussed in-depth below. FIG. 2 is a front perspective view of the dispenser 10, illustrating the mounting structure 30 mounted upon a wall surface, and the outer container 20 is positioned to be mounted upon the mounting structure 30.

As shown in FIGS. 1-2, the outer container 20 is constructed of two parts, a base portion 23*b* and a cap portion 23*a*, the cap portion 23*a* being removably mounted on the base portion 23 to together define an interior compartment 25 (shown in FIGS. 6-7) for holding an inner container 31, also shown in FIGS. 6-7 and discussed below. Importantly, when the outer container 20 is mounted on the mounting structure 30, the cap portion 23*a* cannot be removed, because the mounting structure 30 prevents it.

As illustrated in FIGS. 1-2, a dispensing mechanism 29 is operably mounted on the outer container 20 for dispensing liquid. In this embodiment, the dispensing mechanism 29 extends through an aperture 27 in the cap portion 23*a*, but in other embodiments, the aperture may be formed in the base portion 23*b*, or in any other location desired by the designer. In this embodiment, the dispensing mechanism 29 is threadedly mounted on the aperture 27, but in other embodiments may be mounted via any suitable means. Furthermore, in some alternatives, the dispensing mechanism 29 dispenses in a manner that does not require it extends through an aperture, but releases liquid using gravity, suction, etc. The dispensing mechanism 29 may be in the form of a wide range of dispensing mechanisms known in the art, e.g., a pump dispenser as illustrated, or alternatively a spray nozzle, squeeze-outlet, faucet, etc., or any other dispenser head known in the art. The dispensing mechanism 29 may be any size, shape, type, and location suitable for dispensing the fluid, and the invention includes any type of dispenser known in the art.

As illustrated, an interlocking structure 24 is provided on the outer container 20, in this embodiment in the forms of a block 24 that extends outwardly from the outer container 20. The interlocking structure 24 includes a top portion 24*a* that extends from the cap portion 23*a*, and a bottom portion 24*b* that extends from the base portion of the outer container 20. The block 24 in this embodiment is a rectangular cuboid structure, although other shapes (e.g., rail, round, triangular cross-sections, etc.) may be used, so long as the block 24 may be engaged with the mounting structure 30, as illustrated. Furthermore, in other embodiments, the block 24 may be in various forms of clips, hooks, arms, etc., which should be considered within the scope of the present invention.

While a block or rail type structure is shown in the current embodiment of the interlocking structure 24, other forms of structures may be used including other male/female structures, or these may be reversed to that it is a female/male configuration that is a mere reversal of the current embodiment.

In some embodiments, the block 24 has a locking feature 26 that prevents removal of the block 24 (or other structure) from the mounting structure. In this embodiment, the locking feature 26 is in the form of at least one bore extending into a side surface 28 of the block 24. In this embodiment, the at least one bore 26 is in the form of two pairs of bores 26, one pair on the cap portion 23*a*, and one pair on the base portion 23*b*, but any suitable number of bores may be included, so long as a suitably strong locking connection is made between the container 20 and the mounting structure 30, discussed further below.

In other embodiments, different forms of locking features 26 may be used to prevent unauthorized removal of the outer container 20, such as a variety of latches and locks that are known in the art of these types of dispensers (e.g., the locking mechanism shown in Park, U.S. Pat. No. 10,527,224, which is hereby incorporated by reference).

In the embodiment shown in FIGS. 1-2, the mounting structure 30 has a front surface 32*a* and a back surface 32*b*, wherein the back surface 32*b* is adapted for mounting on the wall surface 12. The mounting structure 30 also includes opposed side surfaces 33 defining a width W1, and upper and lower portions 34*a* and 34*b* defining a height H1.

In this embodiment, a female receiver 36 is formed in the mounting structure 30, the female receiver 36 being sized and shaped to receive the block 24 of the outer container 20 into the female receiver 36 for mounting on the wall. However, in alternative embodiments, the mounting structure 30 may instead include a male receiver for engaging with a female receiver of the outer container 20. As previously mentioned, in other embodiments, the block 24 may be in various forms of clips, hooks, arms, etc., as long as there are separable top and bottom portions that together engage the mounting structure 30.

In the embodiment of FIGS. 1-2, the mounting structure 30 further comprises a locking structure 38 for locking the block 24 in the female receiver 36 of the mounting structure 30. As shown in FIG. 2, at least one locking post 38 is movably mounted in the female receiver 36 to move between a locked positioned wherein the at least one locking post 38 extends outwardly into the female receiver 36 and interlocks with the at least one bore 26 of the block 24, and an unlocked position wherein the at least one locking post 38 are retracted from the locked position to that the block 24 is released, discussed further below. In this embodiment, the at least one locking post 38 is in the form of four locking posts (two pairs), such that each bore 26 of the block 24 receives a locking post 38 on either side. However, as stated above, any number of locking posts may be included to mount the outer container 20 on the mounting structure 30. Furthermore, in some embodiments, the block 24 includes the locking post(s) 38, and the female receive includes the bore(s) 26. In further alternatives, the locking structure 38 may be any suitable structure known in the art, e.g., a pin/post that extends all the way through the block 24 or extend from the top and/or bottom of the mounting structure 30, a hook or clip mechanism, a clamp mechanism, etc., or the entire block 24 could be magnetically secured within the mounting structure 30, etc. Other alternative structures may be included, as long as the mounting structure 30 is adapted to securely receive the block 24 of the outer container 20.

As illustrated in FIG. 1, in some embodiments, the dispenser 10 includes the unlocking tool 40, which may be in the form of at least one downwardly extending arm 42 that includes at least one magnet 44 for retracting the at least one locking post 38 of the mounting structure 30. In this embodiment, the unlocking tool 40 includes a pair of downwardly extending arms 42 that extend downwardly from an upper cross-bar 46, the arms 42 each having an inner surface 45 spaced a width W2 apart, W2 being approximately equal to or greater than W1 of the mounting structure 30. The inner surface 45 further includes an inner height H2 that is approximately equal to or greater than H1 of the mounting structure 30, such that the pair of arms 42 may be mounted on the opposed side surfaces 33 of the mounting structure 30. In this embodiment, the upper cross-bar 46 is hingeably attached to a tool housing 48, wherein a finger grip 47 of the upper cross-bar 46 may be gripped to hinge the downwardly extending arms 42 between a closed position wherein the downwardly extending arms 42 are seated within receiving cavities 49 of the tool housing 48, to an unlocking position wherein the arms 42 extend downwardly from the tool housing 48. However, in other embodiments, the unlocking tool 40 may exclude the tool housing 48, or the downwardly extending arms 42 may be alternatively attached to the tool housing 48, e.g., slidably attached, removably attached, etc. Furthermore, the upper cross-bar 46 may exclude the finger grip 47, wherein an alternative hinge mechanism may be used (e.g., a press-release mechanism, a switch, etc.). The unlocking tool 40 may be alternatively constructed to compliment any locking mechanism 38 used for the mounting structure 30.

Figure 3:
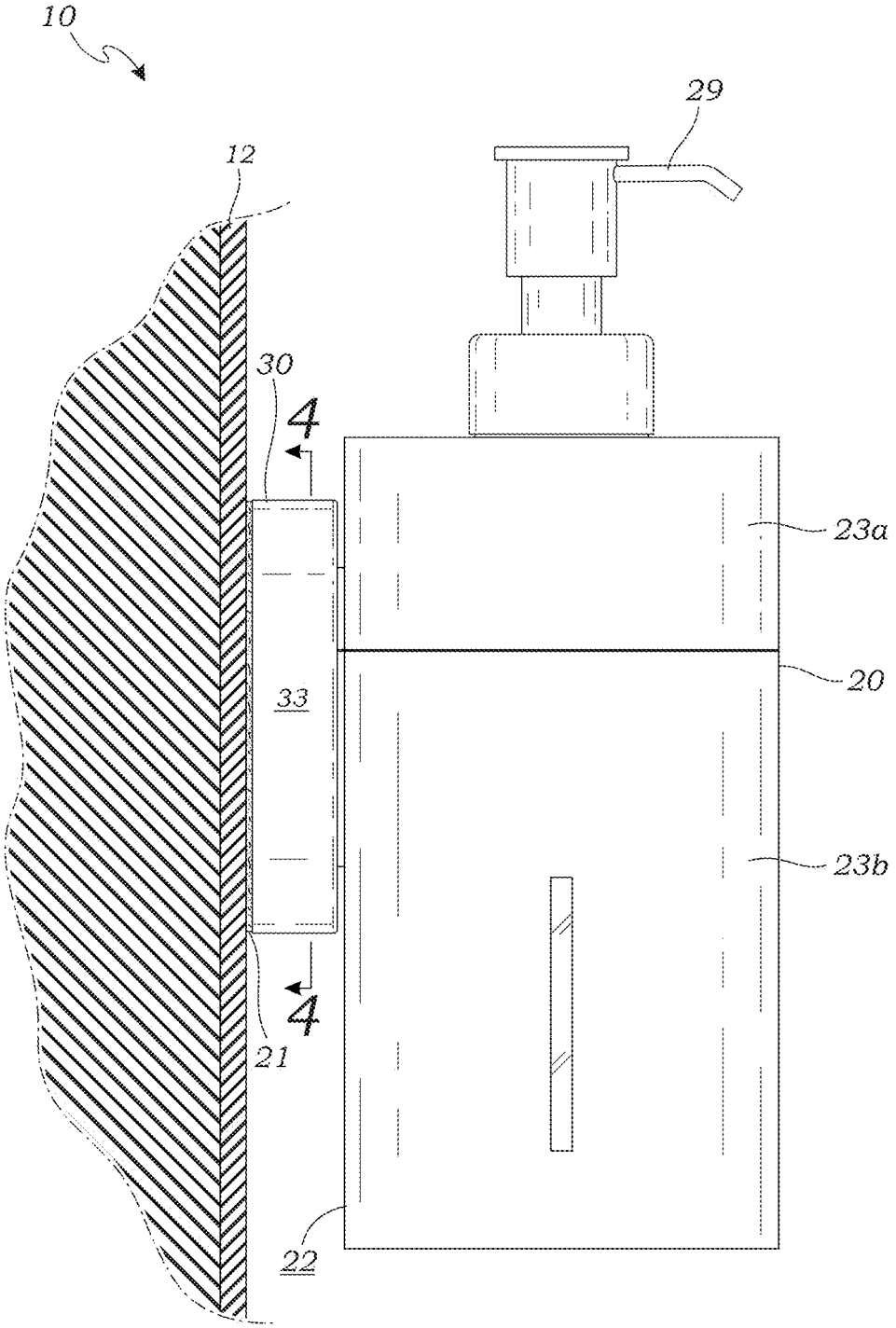
FIG. 3 is a side elevation view of the outer container mounted upon the mounting structure.

FIG. 3 is a side elevation view of the outer container 20 mounted upon the mounting structure 30. As shown in FIG. 3, in this embodiment, the mounting structure 30 is mounted on a shower wall 12 via an adhesive 21 (FIGS. 2-3); however, in alternative embodiments, the mounting structure 30 could be mounted on any other suitable wall or surface, using any mounting means known in the art (e.g., mechanical fasteners such as screws, bolts, hooks, and such, or non-mechanical fasteners such as suction cups, magnets, etc.).

Figure 4:
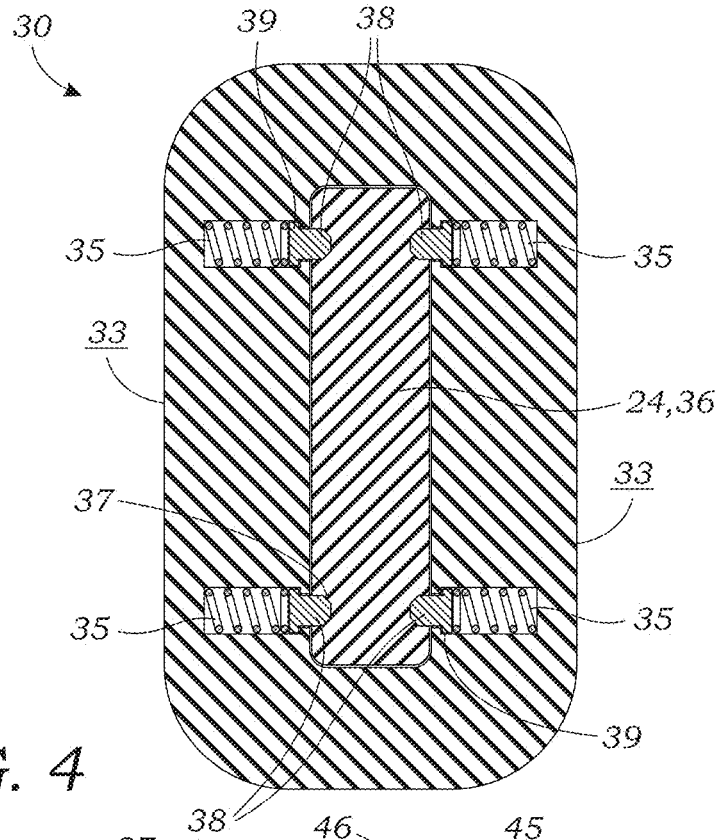
FIG. 4 is a sectional view thereof taken along line 4-4 in FIG. 3, showing a plurality of locking pins of the mounting structure engaged with a mounting block of the outer container, for locking the outer container on the mounting structure.

FIG. 4 is a sectional view of the mounting structure 30 taken along line 4-4 in FIG. 3, illustrating the locking posts 38 of the mounting structure 30 engaged with the bores 26 of the block 24 of the outer container 20, for locking the outer container 20 on the mounting structure 30. As shown in FIG. 4, each locking post 38 includes a biasing mechanism 35 for biasing each of the locking posts 38 towards the locked position. In this embodiment, the biasing mechanism 35 is in the form of a coil spring, but other biasing mechanisms may be used, e.g., other forms of springs, pads/cushions, resilient tabs, etc., or any other form of resilient element. As shown in FIG. 4, each of the locking posts 38 may include a smaller diameter inner end 37, which may be rounded, tapered, or otherwise shaped to facilitate engagement with the block 24. An outer end 39 of the locking post 38 may include a larger diameter to prevent the locking post 38 from passing entirely into the bore 26.

Figure 5:
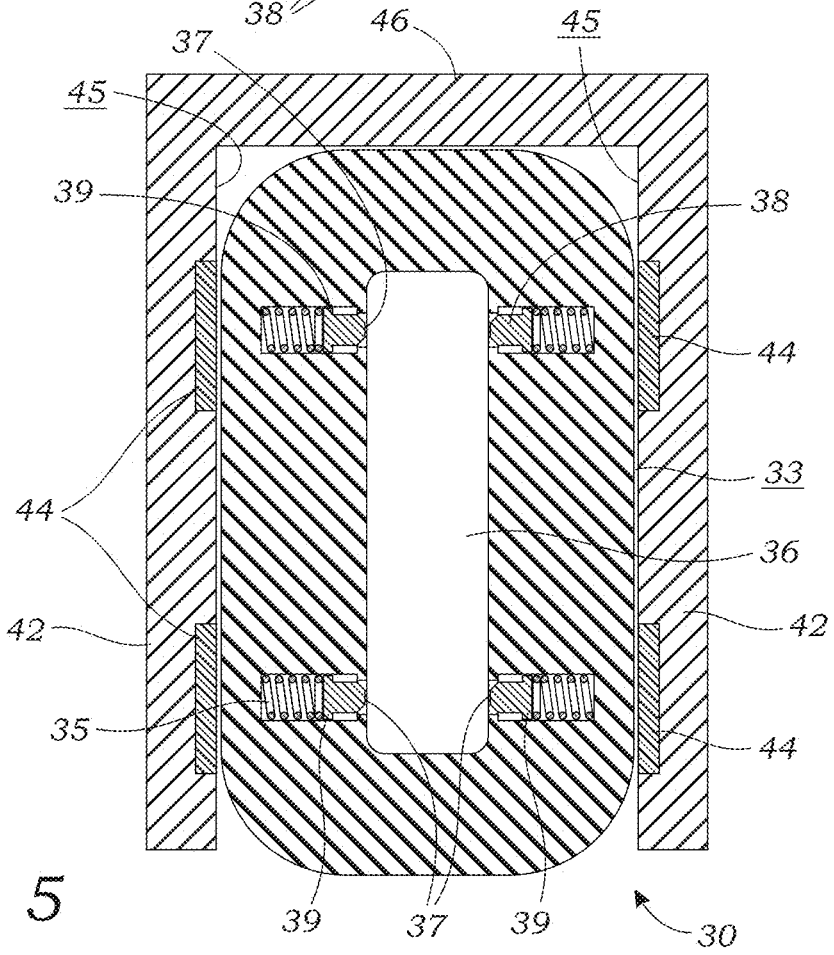
FIG. 5 is a sectional view similar to FIG. 4, wherein the unlocking tool is positioned around the mounting structure so that magnets of the unlocking tool retract the plurality of locking pins so that the outer container may be removed from the mounting structure.

FIG. 5 is a sectional view similar to FIG. 4, wherein the unlocking tool 40 is positioned around the mounting structure 30 so that the at least one magnet 44 of the unlocking tool 40 retracts the at least one locking post 38 so that the block 24 is released and the outer container 20 may be removed from the mounting structure 30. As shown in FIGS. 1 and 5, in this embodiment, the at least one magnet 44 is in the form of four magnets 44 that act to retract the biasing mechanism of each locking post 38. Obviously, in other embodiments, the number of magnets may be any number that compliments the number of locking posts 38, as discussed above.

In some applications of the present invention, the unlocking tool 40 may utilize elements other than the magnets 44 to retract the locking posts 38, e.g., via protrusions that frictionally engage the locking posts 38 and/or biasing mechanisms through the opposed side surfaces 33 of the mounting structure 30, some form of suction mechanism, etc., or any other form of retracting the biasing mechanism.

Figure 6:
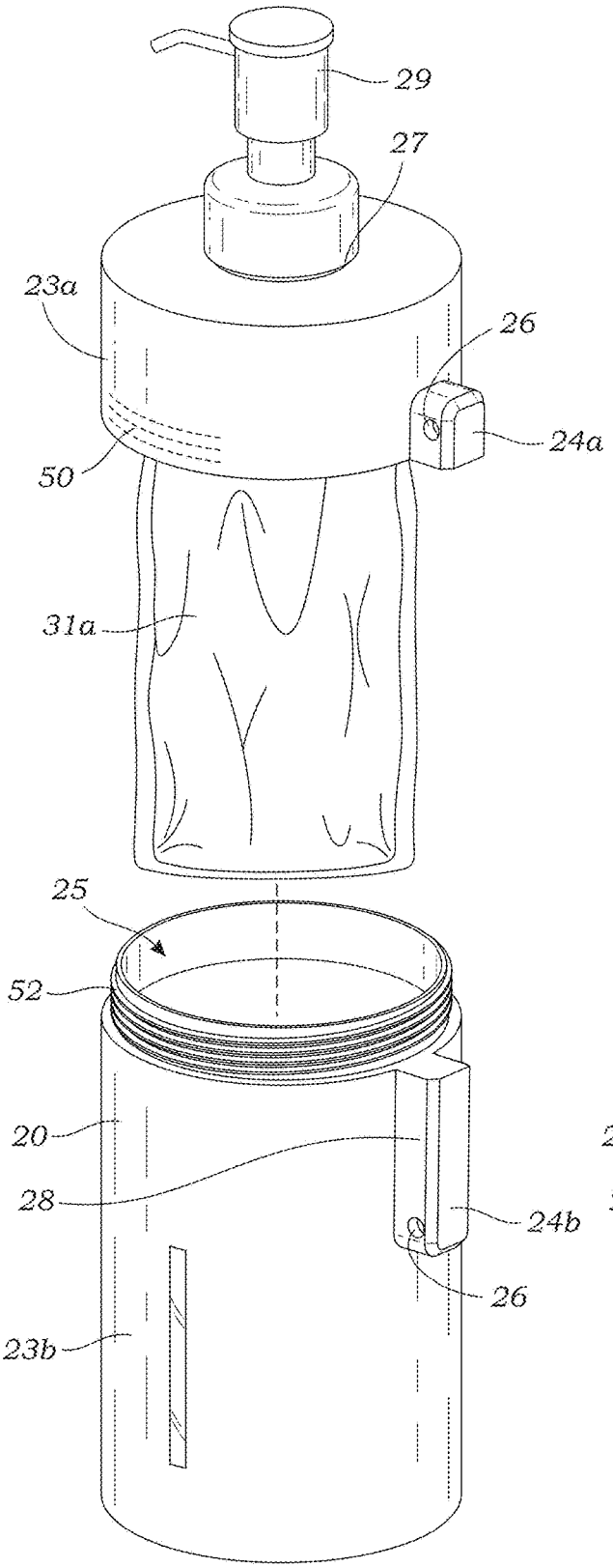
FIG. 6 is an exploded rear perspective view of the dispenser showing one embodiment of an inner container.

FIG. 6 is an exploded rear perspective view of the outer container 20, illustrating an inner container 31*a* that is maintained within the outer container 20. The dispensing mechanism 29 is operably connected to the inner container 31 for dispensing liquid. In this embodiment of the inner container 31*a*, it is in the form of a flexible bag that is filled with the liquid to be dispensed. As shown in FIG. 6, the cap portion 23*a* of the outer container 20 is removably (threadedly) mounted on the base portion 23*b* to together define the interior compartment 25. In this embodiment, the cap portion 23*a* includes a first threaded portion 50, and the base portion 23*b* includes a second threaded portion 52, which threadedly engage each other for attaching or removing the cap portion 23*a*, for accessing the inner container 31*a*. Importantly, when the container 20 is mounted on the mounting mechanism 30, the cap portion 23*a* is prevented from rotation by the block's engagement, thereby preventing access to an inner compartment 54 which containers the inner container 31*a*. This prevents theft of the inner container 31*a* and the liquid stored therein.

As mentioned above, the dispensing mechanism 29 extends through the aperture 27 in the cap portion 23*a*, and the inner container 31*a* is positioned within the interior compartment 25 of the outer container 20 and operably connected with the dispensing mechanism 29. The inner container 31*a* is adapted for storing the fluid so that it may be dispensed through the dispensing mechanism 29. Furthermore, as illustrated, the cap portion 23*a* may be threadedly mounted on the base portion 23*b*. However, in other embodiments, the cap portion 23*a* may be mounted via any other suitable mounting means, e.g., bayonet, etc.

As shown in FIG. 6, in this embodiment, the inner container 31*a* is in the form of a bag, pouch, or similar flexible container, and wherein the pouch 31*a* may expand to be filled with liquid.

Figure 7:
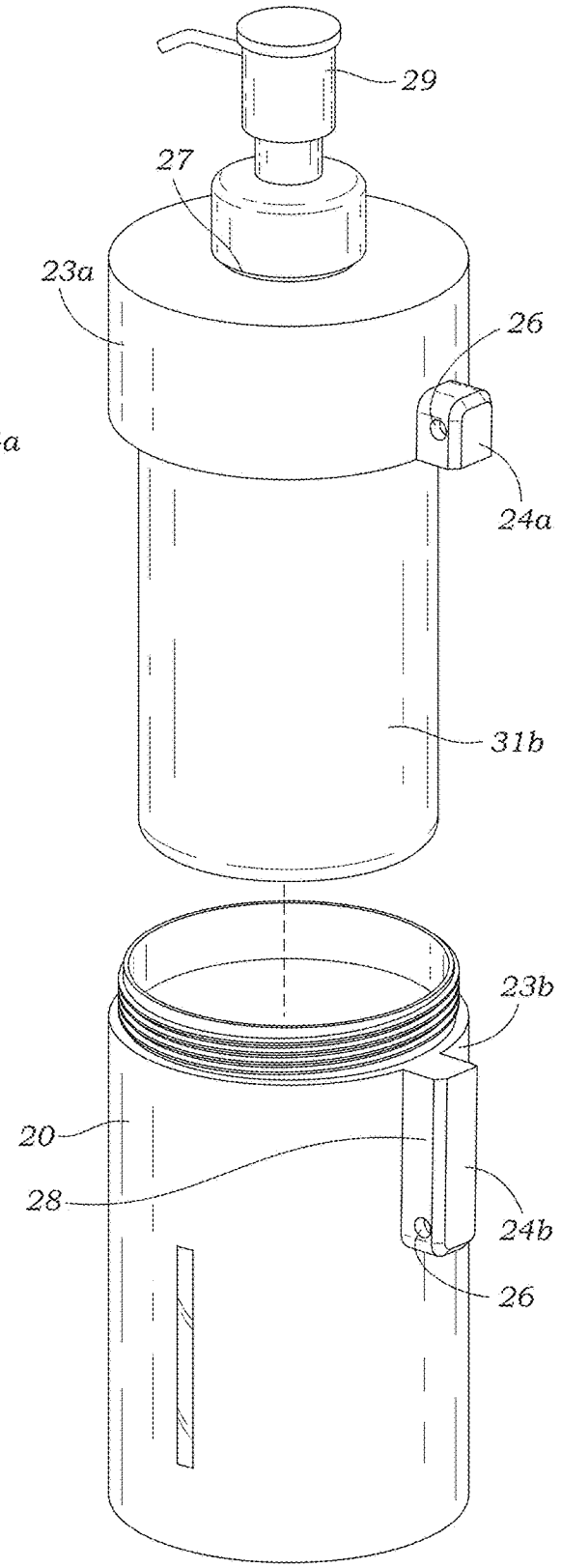
FIG. 7 is an exploded rear perspective view thereof, showing another embodiment of the inner container.

FIG. 7 is an exploded rear perspective view of the outer container 20, showing another embodiment of the inner container 31*b*. As shown in FIG. 7, in this embodiment, the inner container 31*b* is in the form of a rigid container adapted to contain liquid. In this embodiment, the inner container 31*b* may be generally cylindrical and totally rigid (e.g., plastic). Alternatively, the inner container may be only semi-rigid, or in other shapes or configurations. Furthermore, differently-sized inner containers may be provided for holding a desired volume, and other forms of the inner container 31 may be included, provided it is within the scope of the invention as-claimed. For example, a generally conical or elongated cuboid inner container may be used.

The title of the present application, and the claims presented, do not limit what may be claimed in the future, based upon and supported by the present application. Furthermore, any features shown in any of the drawings may be combined with any features from any other drawings to form an invention which may be claimed.

As used in this application, the words "a," "an," and "one" are defined to include one or more of the referenced item unless specifically stated otherwise. The terms "approximately" and "about" are defined to mean +/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by claims made to the invention.

What is claimed is:

1. A dispenser that is adapted for mounting on a wall surface and for dispensing a fluid, the dispenser comprising:

an outer container having a base portion and a cap portion, the cap portion being removably mounted on the base portion to together define an interior compartment;

an inner container positioned within the interior compartment of the outer container and operably connected with a dispensing mechanism, the inner container being adapted for storing the fluid so that the fluid may be dispensed through the dispensing mechanism;

a block extending outwardly from the outer container, the block having a top block portion that extends from the cap portion, and a bottom block portion that extends from the base portion of the outer container; and a mounting structure having a front surface and a back surface, wherein the back surface of the mounting structure is adapted for mounting on the wall surface;

a female receiver formed in the mounting structure, the female receiver being sized and shaped to receive the block into the female receiver.

2. The dispenser of claim 1, wherein the block has at least one bore extending into a side surface of the block.

3. The dispenser of claim 1, further comprising a locking structure for locking the block in the female receiver of the mounting structure.

4. The dispenser of claim 3, wherein the locking structure includes at least one locking post movably mounted in the female receiver to move between a locked positioned wherein the at least one locking post extends outwardly into the female receiver and interlocks with the at least one bore of the block, and an unlocked position wherein the at least one locking post are retracted from the locked position so that the block is released; and a biasing mechanism for biasing the at least one locking post towards the locked position.

5. The dispenser of claim 4, further having an unlocking tool comprising at least one downwardly extending arm that includes at least one magnet for retracting the at least one locking post of the mounting structure so that the block is released and the outer container may be removed from the mounting structure.

6. The dispenser of claim 1, wherein the cap portion is threadedly mounted on the base portion.

* * * * *